US005645447A

United States Patent [19]

Sandor

[11] Patent Number: 5,645,447

[45] Date of Patent: Jul. 8, 1997

[54] ELECTRICAL CONNECTOR WITH FUNNEL CAP

[75] Inventor: John L. Sandor, Wallingford, Conn.

[73] Assignee: Hubbell Incorporated, Orange, Conn.

[21] Appl. No.: 694,007

[22] Filed: Aug. 7, 1996

Related U.S. Application Data

[63] Continuation of Ser. No. 474,171, Jun. 7, 1995, abandoned.

[51] Int. Cl.[6] ..... H01R 13/58

[52] U.S. Cl. ..... 439/467

[58] Field of Search ..... 439/467, 465

[56] References Cited

U.S. PATENT DOCUMENTS

| | | | |
|---|---|---|---|
| 3,829,819 | 8/1974 | Eckart | 439/142 |
| 3,856,376 | 12/1974 | Poliak | 439/465 |
| 3,891,297 | 6/1975 | Poliak et al. | 439/657 |
| 4,010,999 | 3/1977 | Hoffman | 439/467 |
| 4,108,527 | 8/1978 | Douty et al. | 439/465 |
| 4,138,185 | 2/1979 | Jaconette, Jr. | 439/467 |
| 4,210,380 | 7/1980 | Brzostek | 439/687 |
| 4,213,667 | 7/1980 | Wittes | 439/469 |
| 4,634,211 | 1/1987 | Poliak et al. | 439/106 |
| 4,836,805 | 6/1989 | Poliak et al. | 439/657 |
| 5,021,006 | 6/1991 | Fargeaud et al. | 439/469 |

OTHER PUBLICATIONS

Hubbell Wiring Devices & Systems, Kellems Wire Management, Marine Wiring Products Catalog 2000, pp. A–24, A–25, A–26, M–21.

Photographs of Pass & Seymour's Plug—Prior to Jun. 7, 1995.

Photographs of Hubbell Inc.'s Plug—Prior to Jun. 7, 1995.

Photographs of General Electric's Plug—Prior to Jun. 7, 1995.

*Primary Examiner*—Neil Abrams

*Assistant Examiner*—T. C. Patel

*Attorney, Agent, or Firm*—Jerry M. Presson; David L. Tarnoff

[57] ABSTRACT

An electrical connector is disclosed for securing an end of an electrical cord to an electrical device or cord connector. The electrical connector preferably has a pair of housing halves, a contact retainer body with integral front face and a funnel cap. The funnel cap retains the blade assembly or terminals within the contact retainer body and funnels the wiring of the electrical cord into the contact retainer body for connection with the terminals of the electrical connector. The funnel cap is first releasably coupled to the contact retainer body by a tight-fit such as a press-fit or a snap-fit during wiring of the electrical connector, and then positively retained to the contact retainer body by features of the housing of the electrical connector after complete assembly of the electrical connector.

32 Claims, 12 Drawing Sheets

ELECTRICAL CONNECTOR WITH FUNNEL CAP

This is a continuation of application Ser. No. 08/474,171 filed Jun. 7, 1995 abandoned.

FIELD OF THE INVENTION

The present invention relates to a funnel cap for retaining the blade assembly or terminals of an electrical wiring device or cord connector, and for funneling the wiring of the electrical wiring device or connector. More specifically, this invention relates to a funnel cap in combination with an electrical cord connector in which the funnel cap is releasably retained to the contact retainer body by a press-fit or a snap-fit during wiring of the connector, and then positively retained to the contact retainer body by features of the housing of the electrical cord connector after complete assembly of the connector.

BACKGROUND OF THE INVENTION

Electrical wiring devices fall into many different categories depending upon various aspects of the electrical wiring device. For example, dead front electrical connectors typically fall into the category of electrical wiring devices known generally in the trade as electrical cord connectors. Cord connectors of this type may be male or female, and are generally attached to the end of an insulated cord or cable for use in supplying power to electrical equipment, appliances or the like. A male cord connector is often referred to as a plug, while a female cord connector is often referred to as a receptacle.

Electrical cord connectors of this type are often attached to the associated conductors in situ, and in the circumstances it is important that the connector be adapted for quick and easy attachment to its associated conductor, and in a manner to assure against loosening of the desired electrical connection of the conductors to the terminals of the connector during regular use of the device. This is of particular importance considering the fact that the device may be subjected to hard and frequent use in shops, factories, and other commercial establishments, as well as in residential environments.

The electrical cord connector may be generally classified as being of the type in which the cord is inserted in one end of a housing with its conductors coupled in a forward portion of the housing to the terminals of the male or female contacts, and provided, in the present instance, with a "dead front" for safety purposes.

Currently, there are many different types of electrical cord connectors available on the market. However, these prior electrical cord connectors often suffer from many disadvantages to them. In some instances, the electrical cord connectors of the prior art have been exceedingly expensive, having a large number of parts which not only are high in cost, considering the cost of the parts themselves, but also, involve excessive expenditure as regards assembly labor.

In other instances, the electrical cord connectors of the prior art have had the undesirable characteristic wherein they can be assembled on the job, or by the ultimate purchaser, only at the cost of an excessive amount of time. In such instances, it has been common to provide one or more screws, which must be individually threaded into cooperating openings on one of the connector parts, for the purpose of assembling the cooperating connector part or parts therewith.

In view of the above, it is apparent that there exists a need for an electrical wiring device or cord connector which is relatively inexpensive to manufacture and easy to assemble on an end of an electrical cord, and which will overcome the above-mentioned problems of the prior art devices. This invention addresses this need in the art along with other needs which will become apparent to those skilled in the art once given this disclosure.

SUMMARY OF THE INVENTION

One object of the present invention is to provide an electric connector with a funnel cap which is economical to manufacture.

Another object of the present invention is to provide an electrical connector with a funnel cap which is simple to handle and use.

Still another object of the present invention is to provide an electrical device with a pair of housing halves with retaining members to hold a funnel cap against a contact retainer body for positively retaining the contact terminals in the contact retainer body and for funneling the wires of the electrical cord to the terminals of the electrical connector.

Yet another object of the present invention is to provide an electrical device with a funnel cap that is press-fitted or snap-fitted onto the contact retainer body during assembly of electrical connector.

The foregoing objects are basically attained by an electrical device adapted to be coupled to an end of an electrical cord with a plurality of electrical conductors, comprising a housing including first and second housing halves coupled together to form an electrical cord receiving cavity therebetween, at least one of the cover halves having a retaining member coupled thereto; a contact retainer body with a plurality of terminals coupled thereto, the contact retainer body being coupled to the housing; and a funnel cap with wire openings being retained to the contact retainer body by the retaining member for retaining the terminals in the contact retainer body and for funneling the electrical conductors to the terminals, the contact retainer body and the retaining member being positioned relative to each other to non-movably hold the funnel cap within the housing.

Other objects, advantages and salient features of the present invention will become apparent to those skilled in the art from the following detailed description, which taken in conjunction with the annexed drawings, discloses preferred embodiments of the present invention.

BRIEF DESCRIPTION OF THE DRAWINGS

Referring now to the drawings which form part of this original disclosure.

DETAILED DESCRIPTION OF THE PREFERRED EMBODIMENTS

Referring initially to FIGS. 1–4, an electrical wiring device or cord connector 10 in accordance with a first embodiment of the present invention is illustrated. Electrical cord connector 10 is attached to one end of an electrical cord 12 having three electrical conductors 14 for attaching to terminals or blade contacts 16.

Figure 1:
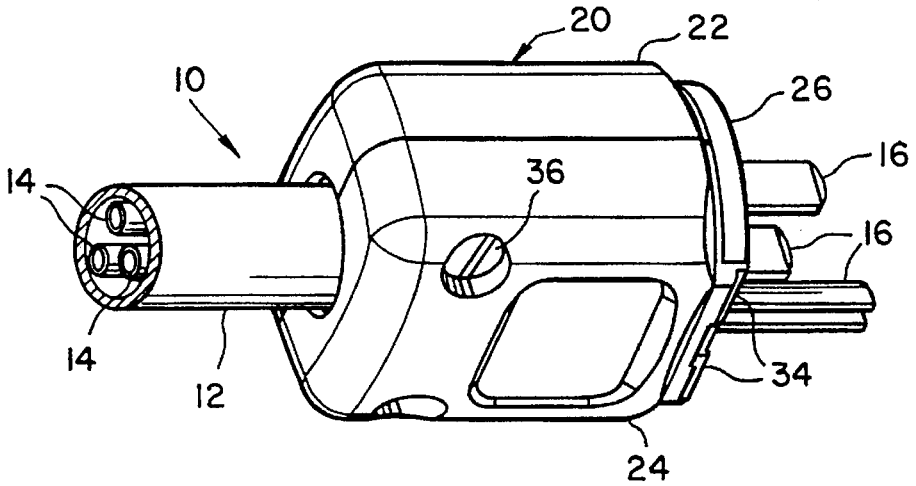
FIG. 1 is a bottom end perspective view of an electrical cord connector in the form of a plug in accordance with a first embodiment of the present invention coupled to an electrical cord.
Figure 2:
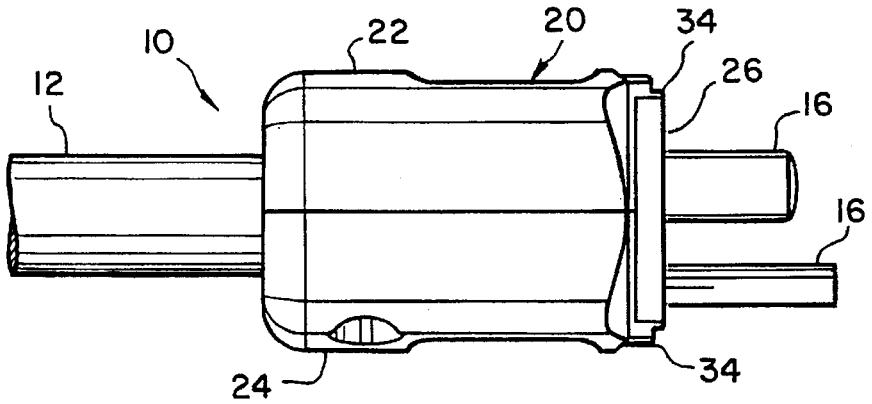
FIG. 2 is a side elevational view of the electrical cord connector illustrated in FIG. 1.

As seen in FIG. 1, electrical cord 12 is a conventional electrical cord, and thus, will not be discussed in detail herein. By way of example, electrical cord 12 preferably has three electrical conductors 14, encased in an insulating sheath. Each of the conductors 14 has a conductive core and an insulating sheath thereon. The end of electrical conductors 14 are stripped for attaching to terminals 16. While three conductors 14 are illustrated, it will be apparent to those skilled in the art that the present invention can be utilized with an electrical cord having only two electrical conductors or an electrical cord having more than three electrical conductors. Of course, if more than three electrical conductors are utilized, certain modifications have to be made to electrical connector 10 disclosed herein to accommodate the additional conductor or conductors.

Figure 4:
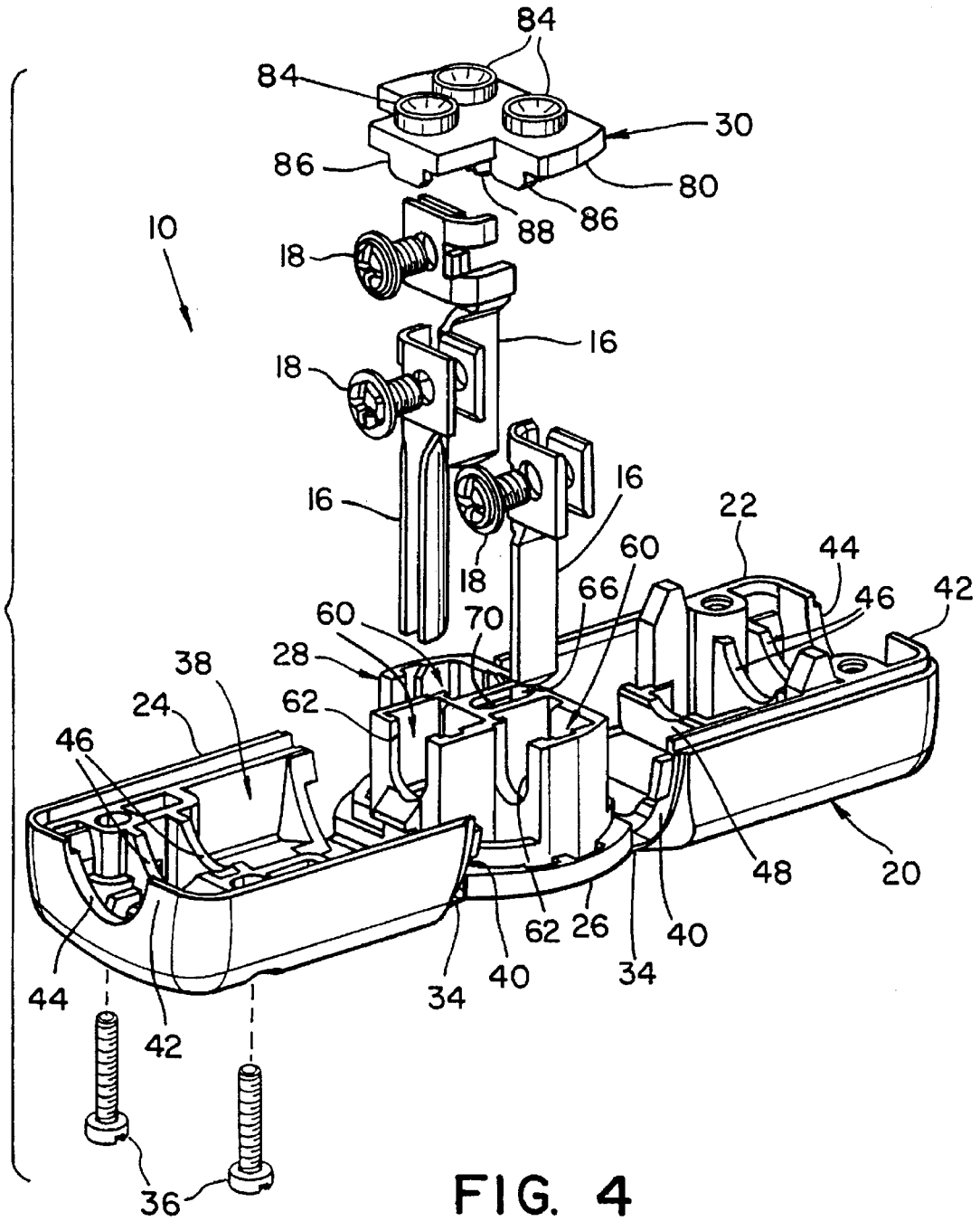
FIG. 4 is an exploded perspective view of the electrical cord connector illustrated in FIGS. 1–3.
Figure 5:
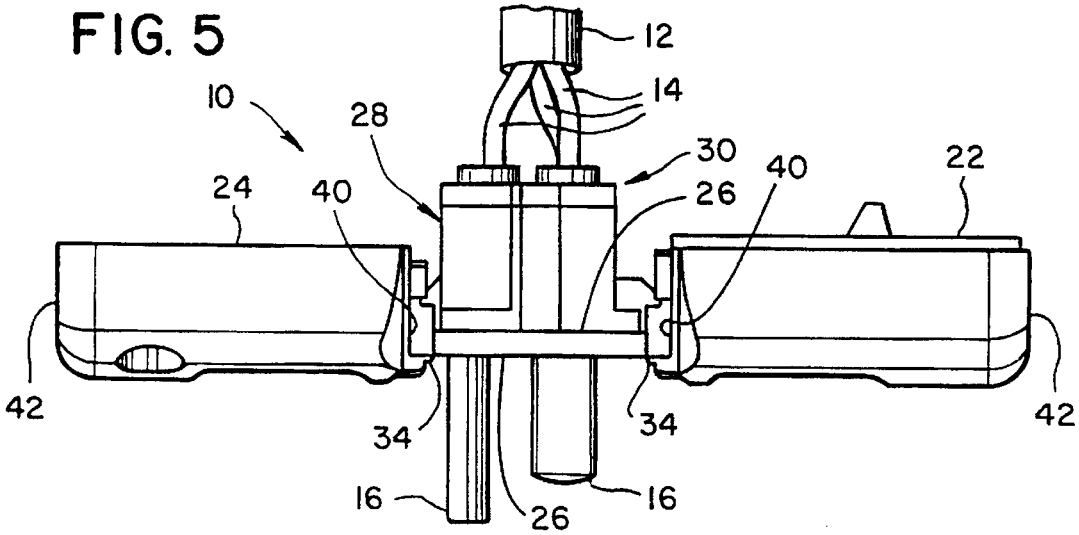
FIG. 5 is a side elevational view of the electrical cord connector illustrated in FIGS. 1–4.

As seen in FIG. 4, terminals 16 are preferably conventional male blade contacts with screws 18 for securing the stripped end of electrical conductors 14 thereto. Accordingly, terminals 16 will not be discussed or illustrated in detail herein. Electrical cord connector 10 has an electrical connector housing 20 formed of a hard, rigid insulating material. For example, housing 20 can be made of a rigid plastic material such as nylon. Housing 20 covers the interconnection of electrical conductors 14 of electrical cord 12 with terminals 16.

Electrical connector housing 20 is preferably a modified version of the electrical connector housings illustrated and disclosed in U.S. Pat. No. 4,010,999 to Hoffman and U.S. Pat. No. 4,138,185 to Jaconette, Jr. The disclosure of these two U.S. patents are hereby incorporated herein by reference. Accordingly, electrical connector housing 20 will only be discussed herein as necessary to understand the present invention.

Housing 20 comprises a first cover half 22, a second cover half 24, a front cover face 26 and a contact retainer body 28. Preferably, first cover half 22, second cover half 24 and front cover face 26 along with contact retainer body 28 are integrally formed as a one-piece, integral unit of a suitable insulating material such as nylon. More specifically, front cover half 22 and second cover half 24 are hinged to front cover face 26 by web hinges 34, while contact retainer body 28 is integrally formed with front cover face 26 and extends from the interior surface of front cover face 26 between cover halves 22 and 24.

As seen in FIGS. 1 and 4, electrical connector housing 20 is held in its assembled position by a pair screws 36. Of course, other types of fastening members can be utilized to hold cover halves 22 and 24 together. For example, U.S. Pat. No. 4,108,527 to Douty et al and U.S. Pat. No. 5,217,389 to Mackay et al disclose cover halves coupled together utilizing fasteners other than screws which could be utilized to interconnect cover halves 22 and 24 together in the present invention.

Housing 20 is also provided with a funnel cap 30 for funneling electrical connectors 14 within housing 20 to terminals 16 and for preventing terminals 16 from moving within housing 20. Funnel cap 30 is designed to aid in the assembly by being releasably coupled to contact retainer body 28 without screws or the like to hold terminals 16 in place during assembly of electrical connector 10. After electrical connector 10 is fully assembled, funnel cap 30 retains terminals 16 in place to prevent movement of terminals 16 within housing 20. Funnel cap 30 is discussed in more detail below.

Cover halves 22 and 24 are both U-shaped in transverse cross-section, and have a back portion and a pair of opposed side portions forming a cord receiving cavity 38 when coupled together for accommodating the end of electrical cord 12, contact retainer body 28 and funnel cap 30. Cover halves 22 and 24 are substantially identical except for minor differences to accommodate the wiring and the mating of the two halves 22 and 24 together.

Figure 3:
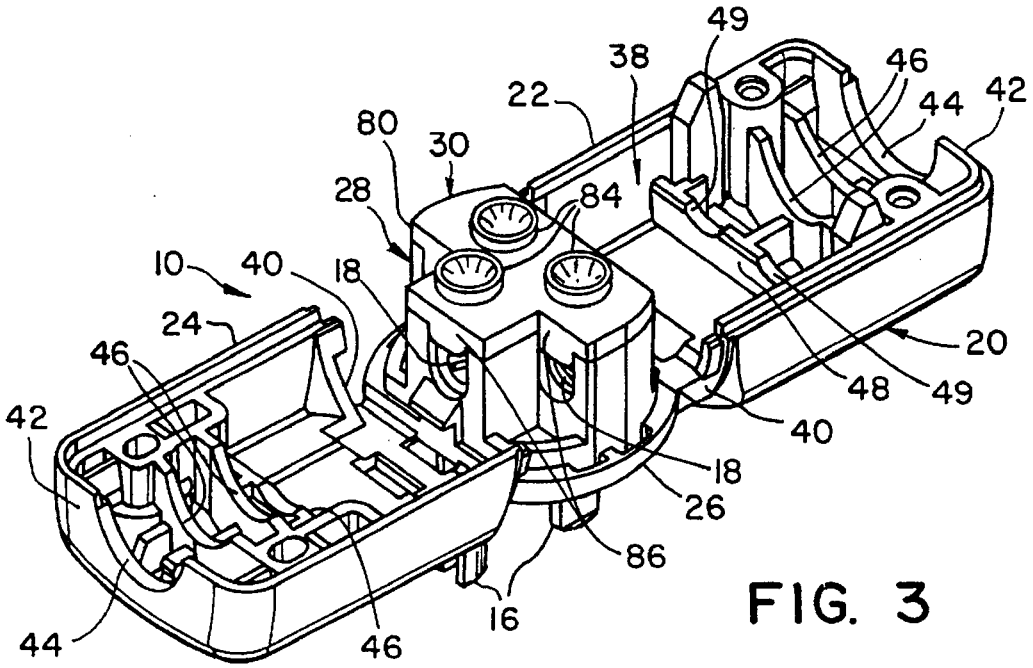
FIG. 3 is a perspective view of the electrical cord connector illustrated in FIGS. 1 and 2 with the cover halves pivoted to a preassembled or opened position.
Figure 6:
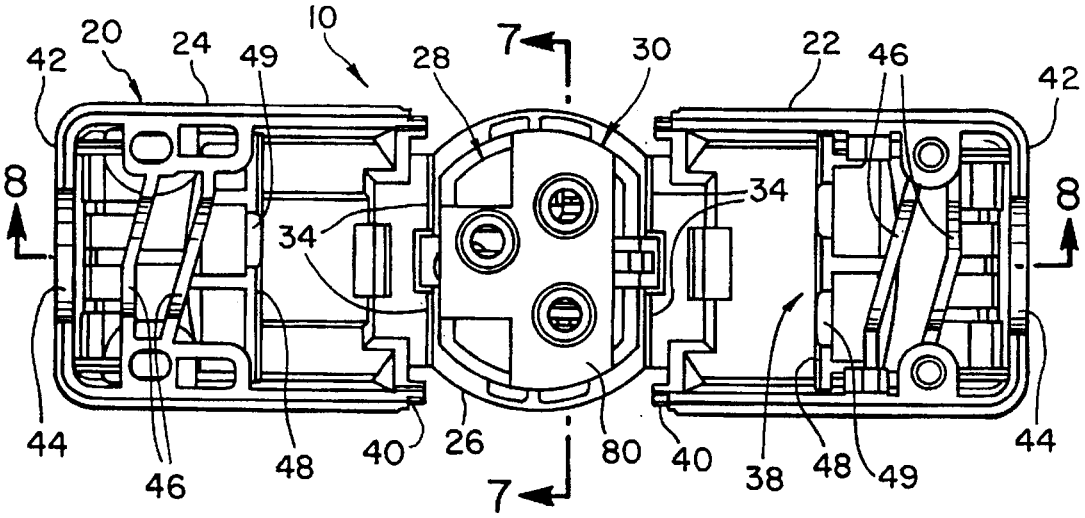
FIG. 6 is a top plan view of the electrical cord connector illustrated in FIGS. 1–5.
Figure 9:
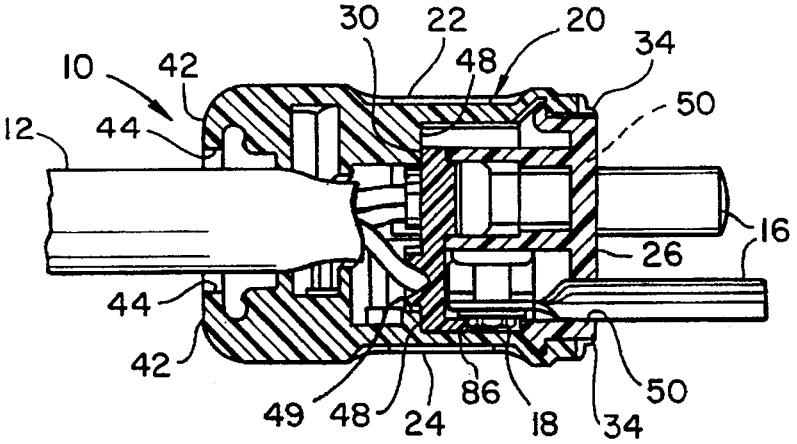
FIG. 9 is a longitudinal cross-sectional view of the electrical cord connector illustrated in FIGS. 1–8.

Each of the cover halves 22 and 24 has a first open end 40 which is coupled to front cover face 26 by web hinges 34, and a second end 42 with a semi-circular cord opening 44 for allowing electrical cord 12 to pass therethrough. Each of the cover halves 22 and 24 also includes a pair of ribs 46 adjacent cord opening 44 for clamping electrical cord 18 therein, and a retaining flange or member 48 for engaging funnel cap 30. As shown in FIGS. 3, 6 and 9, each retaining flange 48 expends perpendicularly from its respective cover half and includes a recessed portion 49 for receiving each portion of a reinforcing rib 84 adjacent thereto.

Accordingly, when electrical cord connector 10 is assembled, electrical conductors 14 of electrical cord 12 are attached to terminals 16, and the end of the electrical cord 12 is clamped between ribs 46 of the cover halves 22 and 24 to retain electrical cord 12 therein. Funnel cap 30 Is prevented from disengaging from contact retainer body 28 since retaining members 48 engage the edge of funnel cap 30 so as to prevent separation of funnel cap 30 from contact retainer body 28. More specifically, funnel cap 30 is sandwiched between retaining members 48 and contact retainer body 28.

Figure 8:
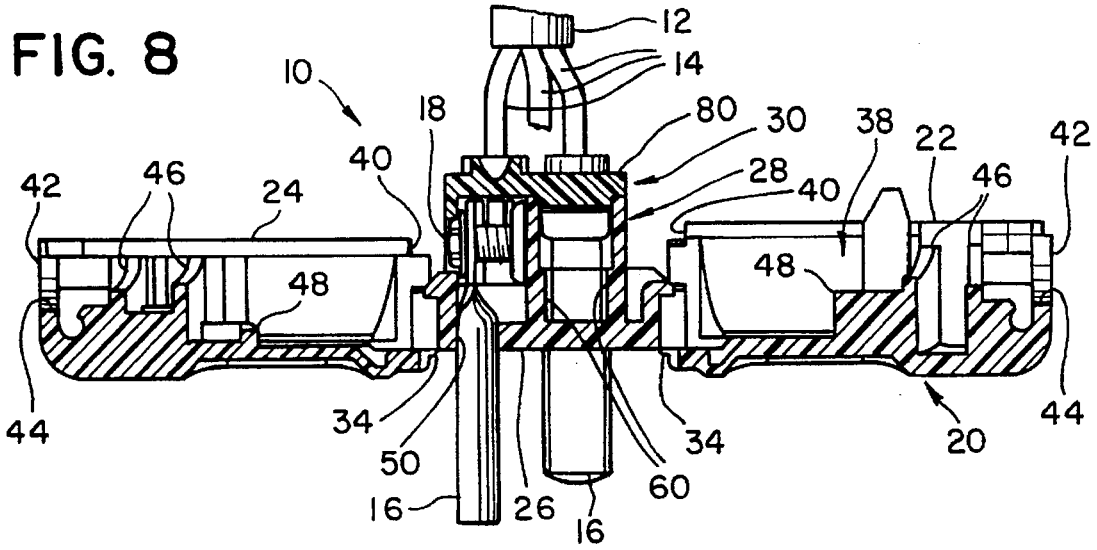
FIG. 8 is a longitudinal cross-sectional view of the electrical cord connector illustrated in FIGS. 1–7 taken along section line 8—8 of FIG. 6.
Figure 10:
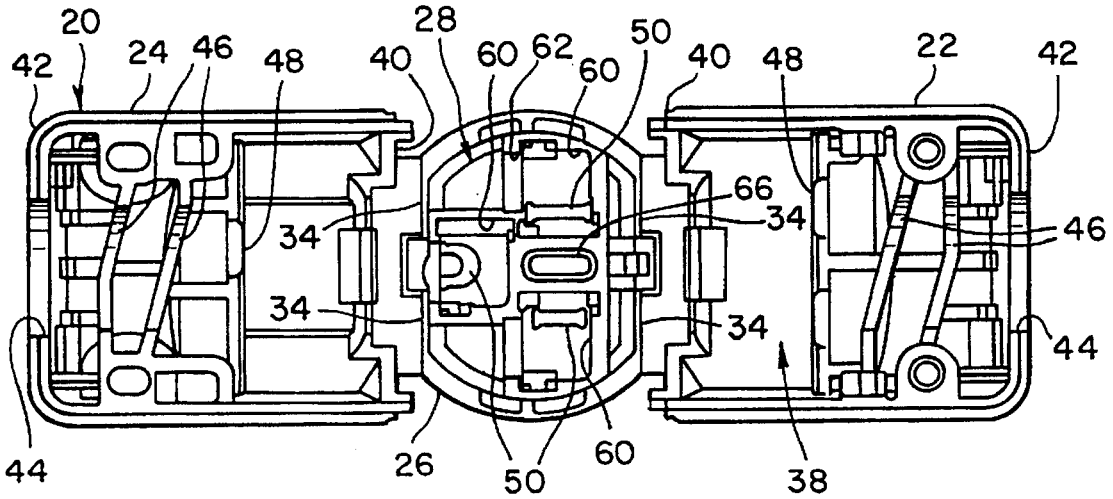
FIG. 10 is a top plan view of the electrical connector housing illustrated in FIGS. 1–4 with the funnel cap and the electrical contacts or terminals removed.
Figure 11:
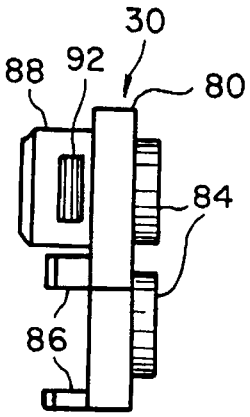
FIG. 11 is a left side elevational view of the funnel cap for the electrical cord connector illustrated in FIGS. 1–9.

As seen in FIGS. 8–10, front cover face 26 has three contact openings 50 therethrough for receiving a portion of terminals 16 therein. While front cover face 26 are disclosed herein as being integrally formed with contact retainer body 28, it will be apparent to those skilled in the art from this disclosure that front cover face 26 and contact retainer body 28 can be made of two pieces, if needed and/or desired.

As best seen in FIGS. 4 and 10, contact retainer body 28 has three longitudinally extending terminal cavities 60 extending substantially perpendicular to front cover face 26 for receiving terminals 16 therein. More specifically, each terminal cavity 60 has a free end remote from front cover face 26 and a fixed end coupled to front cover face 26 at one of its openings 50.

Terminals 16 are inserted into the free end of cavities 60 and preferably press-fitted or frictionally retained into cavities 60 such that a portion of terminals 16 extend outwardly from front cover face 26 via openings 50. Alternatively, terminals 16 may include barbs for engaging the interior surfaces of terminal cavities 60 so as to securely retain terminals 16 therein during assembly.

Contact retainer body 28 also has three access openings 62 with one of the access openings 62 extending into one of the terminal cavities 60. Access openings 62 allow a user to insert a screwdriver or the like therethrough such that the terminal screw 18 can be tightened down upon the corresponding conductor 14 for securely attaching it thereto.

Figure 7:
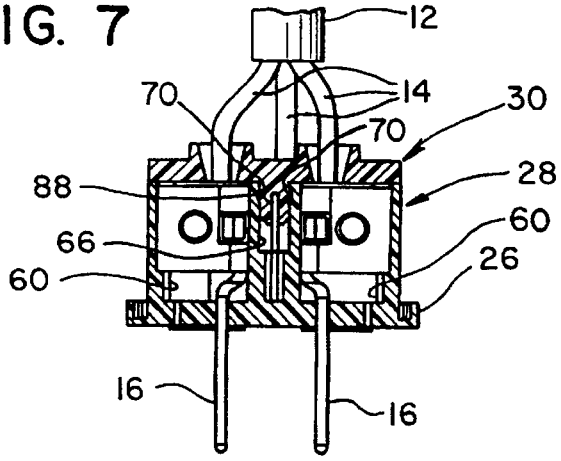
FIG. 7 is a transverse cross-sectional view of the contact retainer body and the funnel cap illustrated in FIGS. 1–6 taken along section line 7—7 of FIG. 6.

As seen in FIGS. 4, 7 and 10, contact retainer body 28 also includes a centrally located socket or bore 66 for receiving a portion of funnel cap 30 therein to overridably retain funnel cap 30 thereto. More specifically, funnel cap 30 is releasably retained to contact retainer body 28 by a tight-fit which is defined herein as including a snap-fit, a press-fit, a friction-fit or the like. This ensures that funnel cap 30 will not be dislodged during wiring or assembly of electrical connector 10. Preferably, as shown in FIGS. 4 and 7, bore 66 has a pair of transverse grooves 70 for creating a snap-fit between funnel cap 30 and contact retainer body 28.

Referring now to FIGS. 11–17, funnel cap 30 is illustrated by itself. Funnel cap 30 includes a cover plate 80 with three wire openings 82 extending therethrough, three circular reinforcing ribs 84 extending outwardly from a first side of cover plate 80, three tabs 86 extending outwardly from the second side of cover plate 80, and a fastening element 88 extending downwardly from the second side of cover plate 80. Funnel cap 30 is constructed of an insulating material such as plastic. Preferably, funnel cap 30 is constructed as a one-piece, unitary member which is molded out of a plastic material such as nylon.

As seen in FIGS. 4–7, cover plate 80 is shaped to overlie and cover the open ends of terminal cavities 60 so as to prevent terminals 16 from falling out of or being pushed out of terminal cavities 60. Accordingly, cover plate 80 is substantially T-shaped in this embodiment.

Wire openings 82 are designed such that one of the wire openings 82 is in communication with one of the terminal cavities 60 such that one of the electrical conductors 14 extends through each of the openings 82 in cover plate 80 and into terminal cavities 60 for attachment to its receptive terminal 16. Wire openings 82 are also positioned sufficiently far apart to keep electrical conductors 14 spread apart as they exit out of the sheath of electrical cord 12. Preferably, wire openings 82 are frustoconical as seen in FIG. 17 so that electrical conductors 14 can be easily inserted therethrough.

Figure 12:
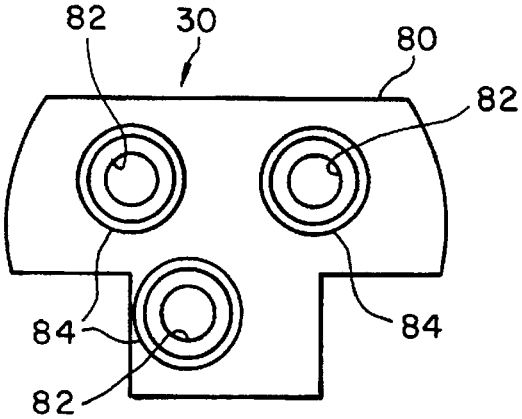
FIG. 12 is a first end elevational view of the funnel cap illustrated in FIG. 11 for the electrical cord connector illustrated in FIGS. 1–9.
Figure 13:
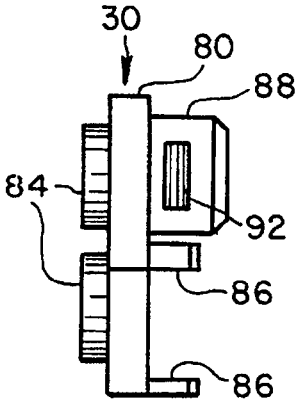
FIG. 13 is a right side elevational view of the funnel cap illustrated in FIGS. 11 and 12 for the electrical cord connector illustrated in FIGS. 1–9.
Figure 14:
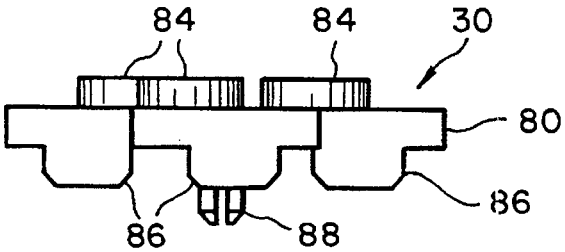
FIG. 14 is a bottom plan view of the funnel cap illustrated in FIGS. 11–13 for the electrical cord connector illustrated in FIGS. 1–9.
Figure 17:
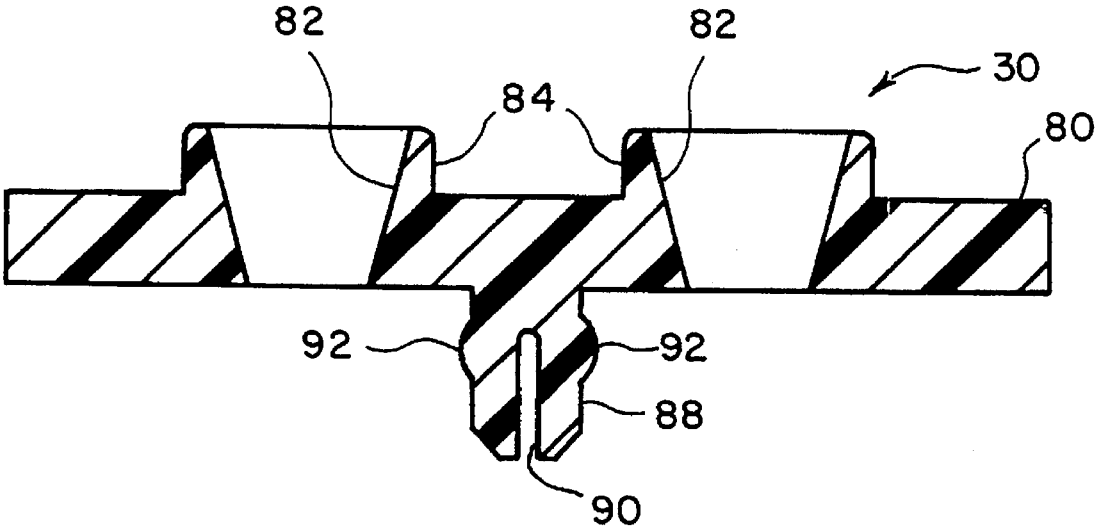
FIG. 17 is an enlarged cross-sectional view of the funnel cap illustrated in FIGS. 11–16 taken along section line 17—17 of FIG. 16.

As seen in FIGS. 12 and 17, ribs 84 encircle wire openings 82 such that the interior surfaces of ribs 82 are contiguous with the interior surfaces of wire openings 82. In other words, the interior surfaces of ribs 84 are frustoconical and form a continuous smooth frustoconical surface with the interior surfaces of openings 82. Ribs 84 provide additional strength to cover plate 80 about wire openings 82.

Tabs 86 are designed to extend into and close off portions of access openings 62 so that only the head of screws 18 are exposed through access openings 62 and funnel cap 30 cannot move relative to contact retainer body 28. Also, tabs 86 help to retain terminals 16 within terminal cavities 60 so that they do not move therein.

Figure 15:
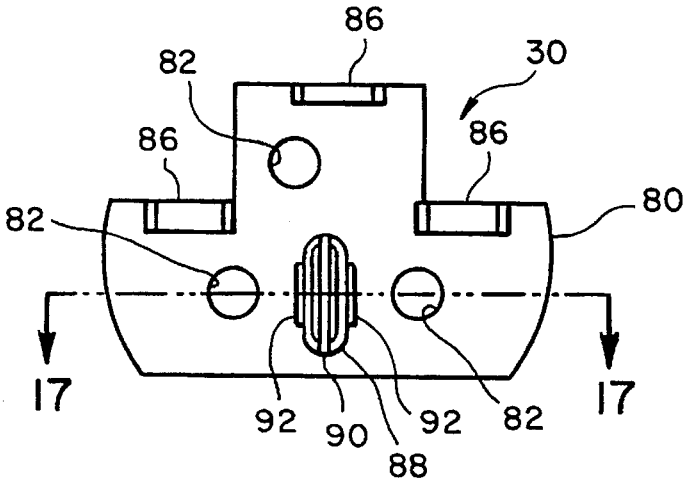
FIG. 15 is a second end elevational view of the funnel cap illustrated in FIGS. 11–14 for the electrical cord connector illustrated in FIGS. 1–9.
Figure 16:
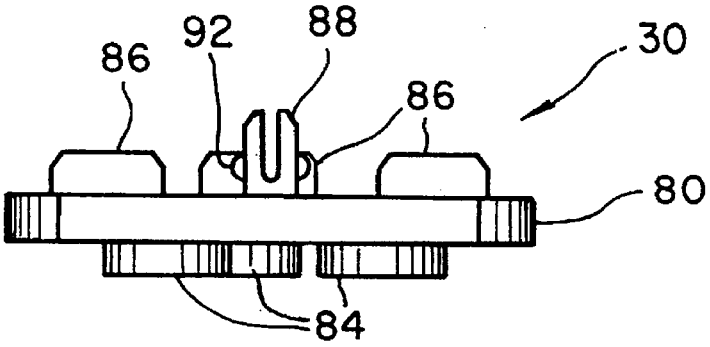
FIG. 16 is a top plan view of the funnel cap illustrated in FIGS. 11–15 for the electrical cord connector illustrated in FIGS. 1–9.

As seen in FIGS. 15 and 17, fastening element 88 has a center slot 90 to add flexibility and resiliency thereto, and a pair of protrusions 92 which are designed to engage grooves 70 formed on the interior surface of bore 66 of contact retainer body 28. In this preferred embodiment, bore 66 and fastening element 88 form a head and socket type snap-fit connection between contact retainer body 28 as shown in FIGS. 4 and 7 and funnel cap 30. Accordingly, funnel cap 30 is releasably retained on contact retainer body 28 via a snap-fit. Of course, this snap-fit can be replaced with a press-fit or a friction-fit type head and socket connection, if needed and/or desired. This head and socket connection retains funnel cap 30 to contact retainer body 28 so that they do not separate during wiring or assembly of electrical cord connector 10.

Assembly of Electrical Cord Connector 10

Electrical cord connector 10 is assembled by first installing terminals 16 into terminal cavities 60 of contact retainer body 28 such that their blade portions extend outwardly from front cover face 26 via openings 50. In this position, terminal screws 18 are aligned within access openings 62 of contact retainer body 28.

Next, funnel cap 30 is coupled to contact retainer body 28 via a tight-fit, e.g., snap-fit. In particular, as seen in FIG. 7, fastening element 88 is inserted into bore 66 such that protrusions 92 engage grooves 70 to overridably retain funnel cap 30 to contact retainer body 28. In this position, cover plate 80 covers the open end of terminal cavities 60 with wire openings 82 of cover plate 80 in communication with terminal cavities 60, and tabs 86 being positioned to close off portions of wire openings 62. Thus, funnel cap 30 can be secured to contact retainer body 28 without any screws and without the fear that funnel cap 30 will be dislodged during wiring or assembly of electrical cord connector 10.

Now, conductors 14 are connected to terminals 16. In particular, the free ends of electrical conductors 14 are inserted through wire openings 82 and into their respective terminal cavities 60 such that the stripped ends of the electrical conductors 14 engage terminals 16. Then, screws 18 are tightened down so that the stripped ends of electrical conductors 14 are electrically and fixedly coupled to terminals 16 in a conventional manner.

After electrical conductors 14 are coupled to terminals 16, one of the housing halves 22 or 24 is pivoted so as to form a 90° angle with front cover face 26. In this position, the end of electrical cord 12 is resting on ribs 46 of the pivoted cover half. The installer then pivots the other cover half 22 or 24 so that its ribs 46 engage electrical cord 12. In this position, retaining members 48 abut against cover plate 80 such that cover plate 80 is sandwiched in between retaining members 48 and the free end of contact retainer body 28 to prevent any movement of funnel cap 30. Accordingly, now funnel cap 30 is securely positioned within housing 20 without screws such that terminals 16 cannot be removed without pivoting the cover halves back to their opened or preassembled positions. Finally, screws 36 are threaded to secure cover halves 22 and 24 together.

Electrical Cord Connector 110

Now referring to FIGS. 18–33, an electrical cord connector 110 is illustrated in the form of a female electrical cord connector in accordance with a second embodiment of the present invention. Electrical cord connector 110 is attached to one end of an electrical cord 112.

Figure 18:
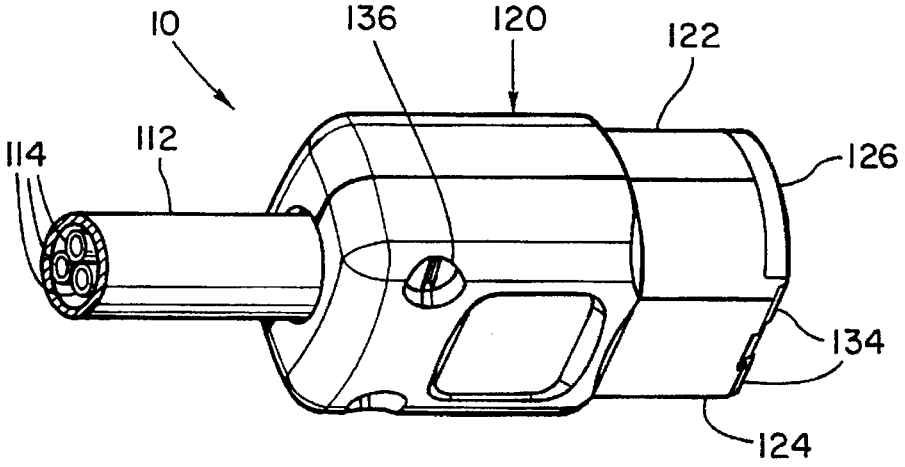
FIG. 18 is a bottom end perspective view of an electrical cord connector in accordance with a second embodiment of the present invention coupled to an electrical cord.
Figure 19:
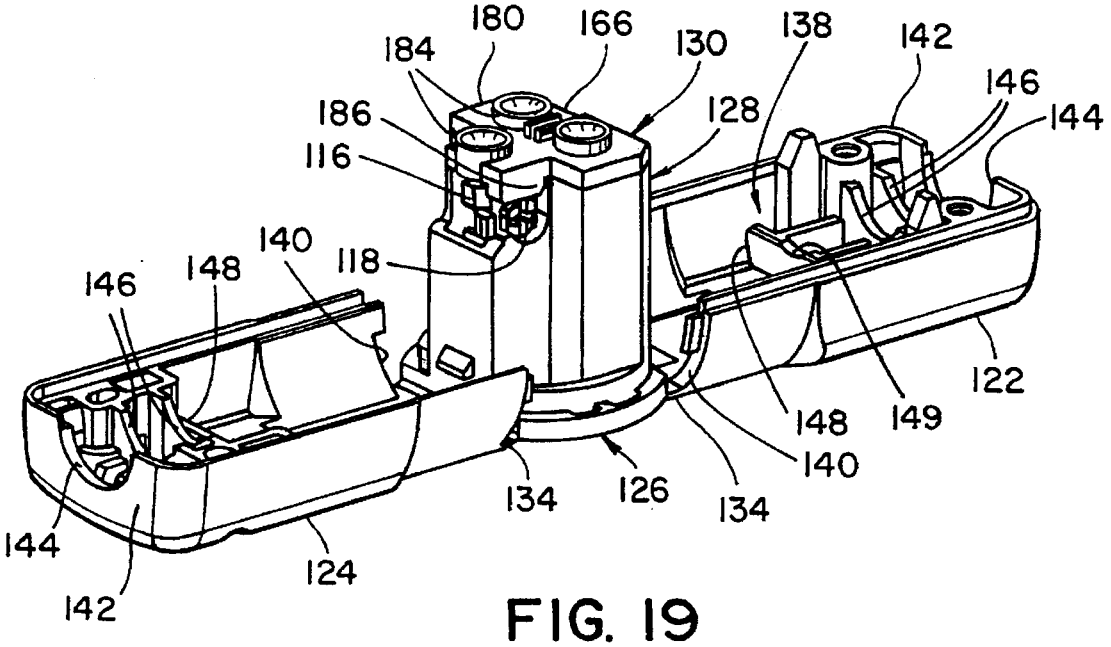
FIG. 19 is a perspective view of the electrical cord connector illustrated in FIG. 18 with the cover halves pivoted to a preassembled or opened position.

As seen in FIG. 18, electrical cord 112 is a conventional electrical cord, and thus, will not be discussed in detail herein. By way of example, electrical cord 112 preferably has three electrical conductors 114, encased in an insulating sheath. Each of the conductors 114 has a conductive core and an insulating sheath thereon. The end of electrical conductors 114 are stripped for attaching to terminals 116. While three conductors 114 are illustrated, it will be apparent to those skilled in the art that the present invention can be utilized with an electrical cord having only two electrical conductors or an electrical cord having more than three electrical conductors. Of course, if more than three electrical conductors are utilized, certain modifications have to be made to electrical connector 110 disclosed herein to accommodate the additional conductor or conductors.

Figure 20:
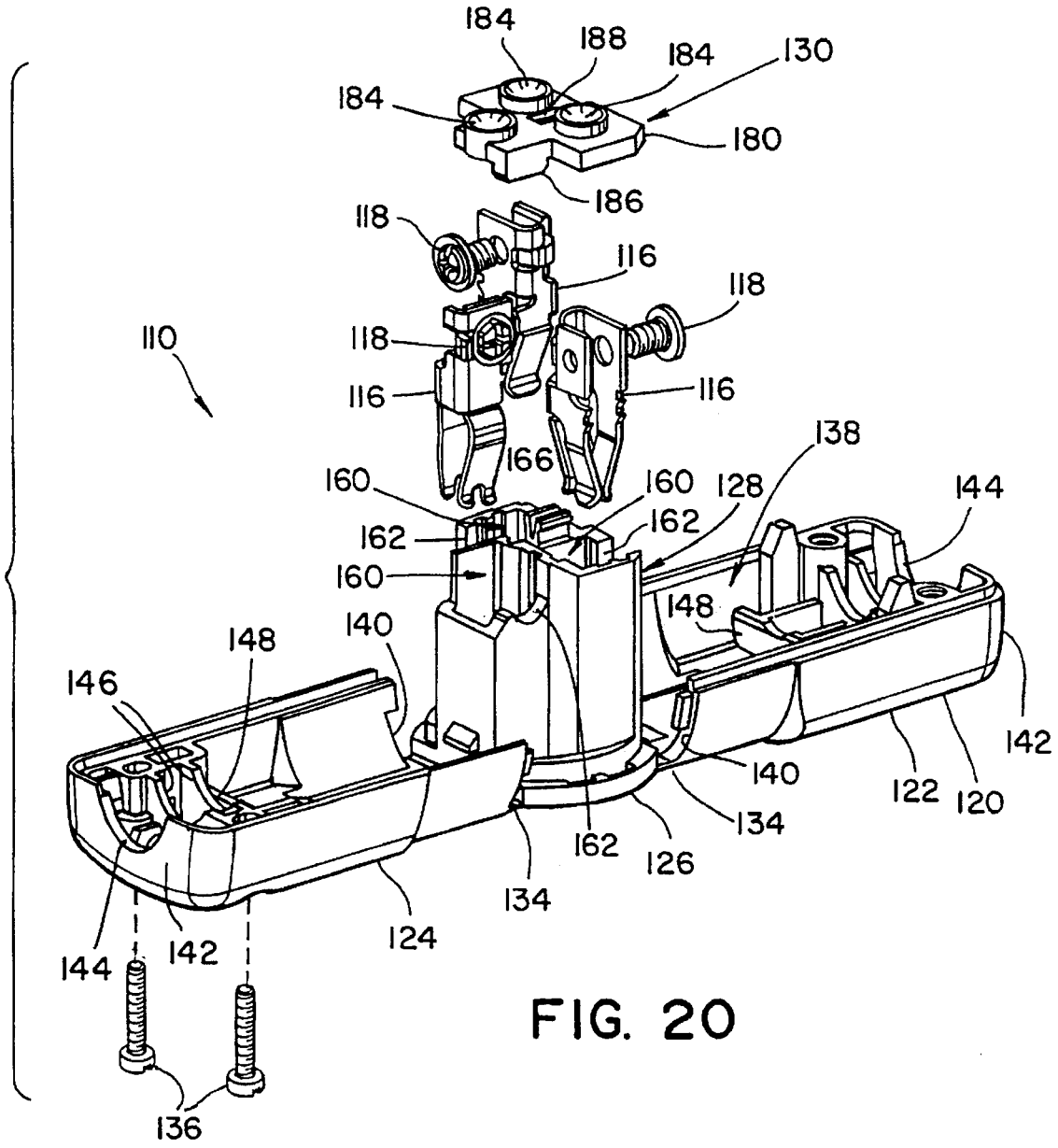
FIG. 20 is an exploded perspective view of the electrical cord connector illustrated in FIGS. 18 and 19.
Figure 21:
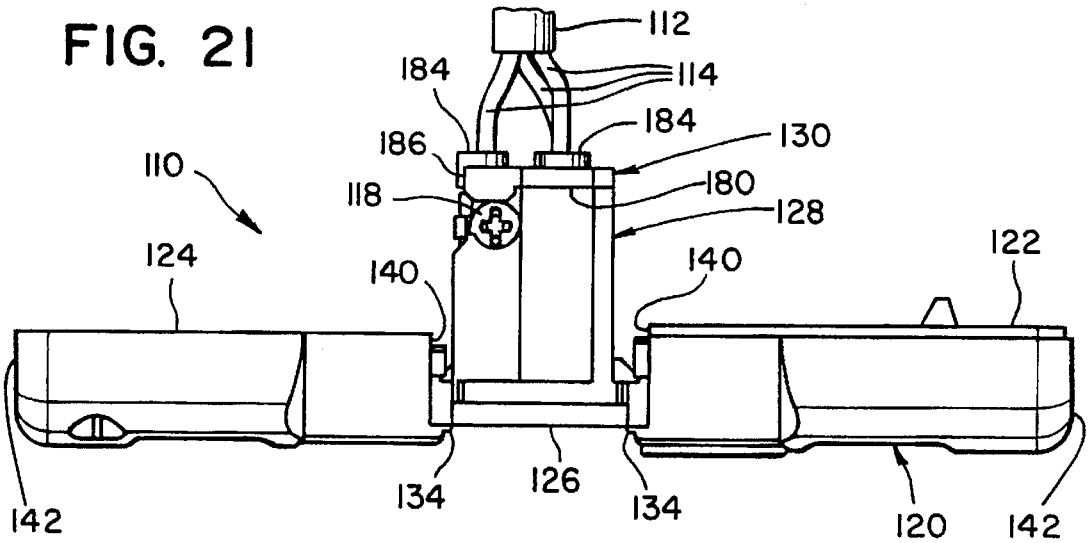
FIG. 21 is a side elevational view of the electrical cord connector illustrated in FIGS. 18–20.
Figure 22:
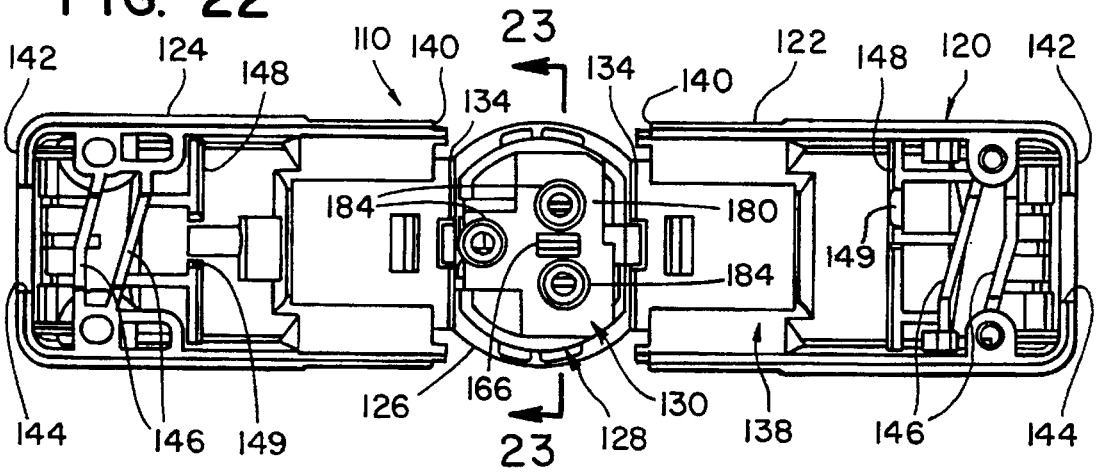
FIG. 22 is a top plan view of the electrical cord connector illustrated in FIGS. 18–21.

As seen in FIG. 20, terminals 116 are preferably conventional female contacts with screws 118 for securing the stripped end of electrical conductors 114 thereto. Accordingly, terminals 116 will not be discussed or illustrated in detail herein.

Electrical cord connector 110 has an electrical connector housing 120 formed of a hard, rigid insulating material. For example, housing 120 can be made of a rigid plastic material such as nylon. Housing 120 covers the interconnection of electrical conductors 114 of electrical cord 112 with the terminals 116. Housing 120 comprises a first cover half 122, a second cover half 124, a front cover face 126 and a contact retainer body 128.

Preferably, first cover half 122, second cover half 124 and front cover face 126 along with contact retainer body 128 are integrally formed as a one-piece, integral unit of a suitable insulating material such as nylon. More specifically, front cover half 122 and second cover half 124 are hinged to front cover face 126 by web hinges 134, while contact retainer body 128 is integrally formed with front cover face 126 and extends from the interior surface of front cover face 126 between cover halves 122 and 124.

Housing 120 is also provided with a funnel cap 130 for funneling electrical connectors 114 within housing 120 to terminals 116 and for preventing terminals 116 from moving within housing 120. Funnel cap 130 is designed to aid in the assembly by being releasably coupled to contact retainer body 128 without screws or the like to hold terminals 116 in place during assembly of electrical connector 110. After electrical connector 110 is fully assembled, funnel cap 130 retains terminals 116 in place to prevent movement of terminals 116 within housing 120. Funnel cap 130 is discussed in more detail below.

Cover halves 122 and 124 form a cord receiving cavity 138 when coupled together for accommodating the end of electrical cord 112, contact retainer body 128 and funnel cap 130. Cover halves 122 and 124 are substantially identical except for minor differences to accommodate the wiring and the mating of the two halves 122 and 124 together.

Each of the cover halves 122 and 124 has a first open end 140 which is coupled to front cover face 126 by web hinges 132, and a second end 142 with a semi-circular cord opening 144 for allowing electrical cord 112 to pass therethrough. Each of the cover halves 122 and 124 also includes a pair of ribs 146 adjacent cord opening 144 for clamping electrical cord 118 therein, and a retaining flange or member 148 for engaging funnel cap 130. As shown in FIGS. 19, 22, 24 and 25, each retaining flange 148 extends perpendicularly from its respective cover half and includes a recessed portion 149 for receiving each portion of a reinforcing rib 184 adjacent thereto.

Accordingly, when electrical cord connector 110 is assembled, electrical conductors 114 of electrical cord 112 are attached to terminals 116, and the end of the electrical cord 112 is clamped between ribs 146 of the cover halves 122 and 124 to retain electrical cord 112 therein. Funnel cap 130 is prevented from disengaging from contact retainer body 128 since retaining members 148 engage the edge of funnel cap 130 so as to prevent separation of funnel cap 130 from contact retainer body 128. More specifically, funnel cap 130 is sandwiched between retaining members 148 and contact retainer body 128.

Contact retainer body 128 has three longitudinally extending terminal cavities 160 for receiving terminals 116 therein. Terminals 116 are preferably press-fitted or frictionally retained into cavities 160. Alternatively, terminals 116 may include barbs for engaging the interior surfaces of terminal cavities 160 so as to securely retain terminals 116 therein during assembly.

Contact retainer body 128 also has three access openings 162 with one of the access openings 162 extending into one of the terminal cavities 160. Access openings 162 allow a user to insert a screwdriver or the like therethrough such that the terminal screw 118 can be tightened down upon the corresponding conductor 114 for securely attaching it thereto.

Contact retainer body 128 also includes a centrally located fastening element or head member 166 for engaging a portion of funnel cap 130 therein to overridably retain funnel cap 130 thereto as discussed below in more detail. Basically, funnel cap 130 is releasably retained to contact retainer body 128 by a tight-fit which is defined herein as including a snap-fit, a press-fit or a friction-fit. This ensures that funnel cap 130 will not be dislodged during wiring or assembly of electrical connector 110. Fastening element 166 has a center slot 168 which forms a pair of flexible and resilient legs 170 with a pair of protrusions 172 for engaging a portion of funnel cap 130 as discussed below.

Referring now to FIGS. 27–33, funnel cap 130 is illustrated by itself. Funnel cap 130 includes a cover plate 180 with three wire openings 182 extending therethrough, three circular reinforcing ribs 184 extending outwardly from a first side of cover plate 180, three tabs 186 extending outwardly from the second side of cover plate 180, and a fastening slot 188 extending through cover plate 180 for releasably receiving fastening element 166. Funnel cap 130 is constructed of an insulating material such as plastic. Preferably, funnel cap 130 is constructed as a one-piece, unitary member which is molded out of a plastic material such as nylon.

Cover plate 180 is shaped to overlie and cover the open ends of terminal cavities 160 so as to prevent terminals 116 from falling out of or being pushed out of terminal cavities 160. Preferably, cover plate 180 is substantially T-shaped.

Wire openings 182 are designed such that one of the wire openings 182 is in communication with one of the terminal cavities 160 such that one of the electrical conductors 114 extends through each of the openings 182 in cover plate 180 and into terminal cavities 160 for attachment to its receptive terminal 116. Wire openings 182 are also positioned sufficiently far apart to keep electrical conductors 114 spread apart as they exit out of the sheath of electrical cord 112. Preferably, wire openings 182 are frustoconical as seen in FIG. 33 so that electrical conductors 114 can be easily inserted therethrough.

Ribs 184 encircle wire openings 182 such that the interior surfaces of ribs 182 are contiguous with the interior surfaces of wire openings 182. In other words, the interior surfaces of ribs 184 are frustoconical and form a continuous smooth frustoconical surface with the interior surfaces of openings 182. Ribs 184 provide additional strength to cover plate 180 about wire openings 182.

Tabs 186 are designed to extend into and close off portions of access openings 162 so that only the head of screws 118 are exposed through access openings 162 and funnel cap 130 cannot move relative to retainer body 128. Also, tabs 186 help to retain terminals 116 within terminal cavities 160 so that they do not move therein.

Fastening slot 188 is preferably a substantially rectangular bore with a tapered portion 190 and a straight tubular portion 192. During assembly of funnel cap 130 onto contact retainer body 128, fastening element 166 engages tapered portion 190 of fastening slot 188, which causes legs 170 of fastening element 166 to deflect inwardly toward each other. After protrusions 172 pass through fastening slot 188, legs 170 of fastening element 166 spring outwardly to their original position such that protrusions 172 engages the outer surface of cover plate 180. In this position, funnel cap 130 is releasably coupled to contact retainer body 128 such that substantially no movement can occur therebetween.

Accordingly, in this preferred embodiment, fastening element 166 and fastening slot 188 form a head and socket type snap-fit connection between contact retainer body 128 and funnel cap 130. This head and socket connection retains funnel cap 130 to contact retainer body 128 so that they do not separate during assembly of electrical cord connector 110.

Assembly of Electrical Cord Connector 110

Electrical cord connector 110 is assembled by first installing terminals 116 into terminal cavities 160 of contact retainer body 128 such that their blade portions extend outwardly from front cover face 126 and with terminal screws 118 being aligned within access openings 162.

Figure 23:
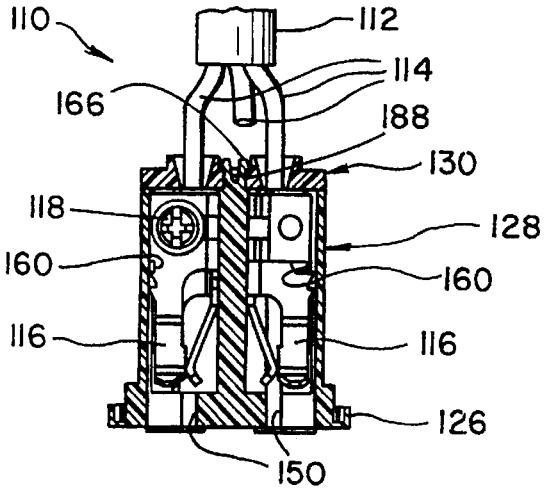
FIG. 23 is a transverse cross-sectional view of the contact retainer body and the funnel cap illustrated in FIGS. 18–22 taken along section line 23–23 of FIG. 22.
Figure 24:
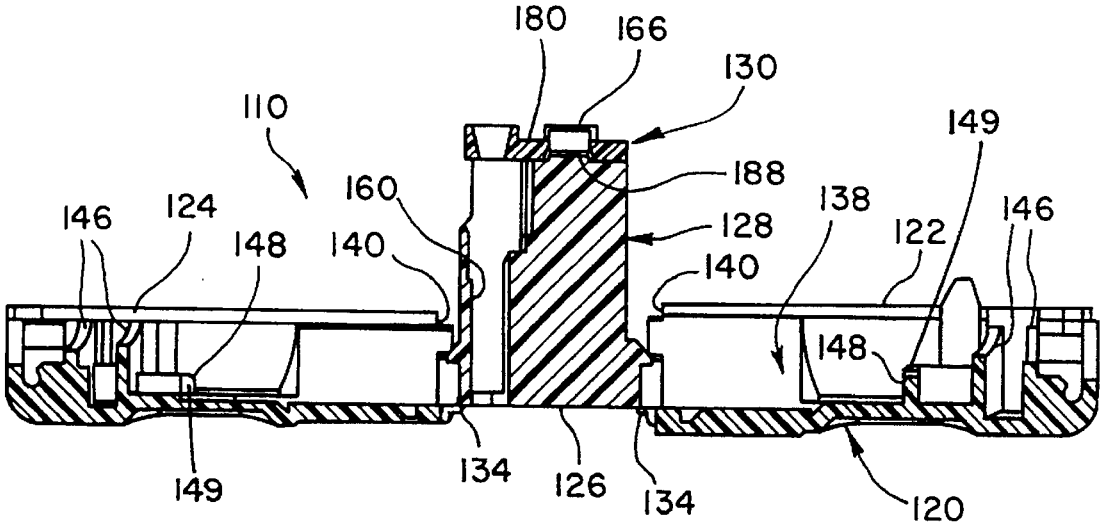
FIG. 24 is a longitudinal cross-sectional view of the electrical cord connector illustrated in FIGS. 18–23 taken along section line 24—24 of FIG. 22 with the terminals or contacts removed for clarity.
Figure 25:
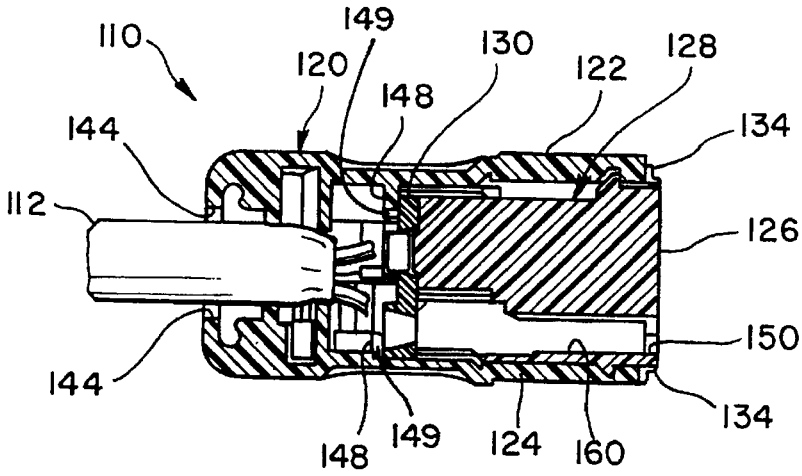
FIG. 25 is a longitudinal cross-sectional view of the electrical cord connector illustrated in FIGS. 18–24 with the terminals or contacts removed for clarity.
Figure 26:
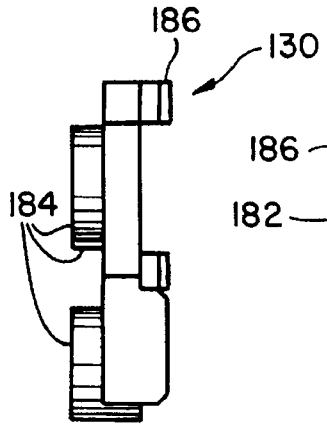
FIG. 26 is a left side elevational view of the funnel cap for the electrical cord connector illustrated in FIGS. 18–25.
Figure 27:
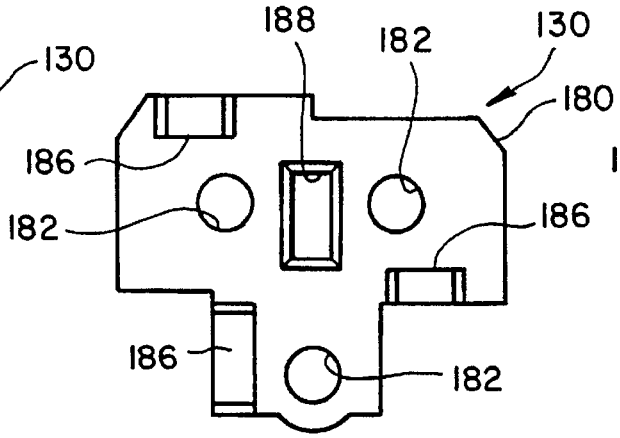
FIG. 27 is a first end elevational view of the funnel cap illustrated in FIG. 26 for the electrical cord connector illustrated in FIGS. 18–25.
Figure 28:
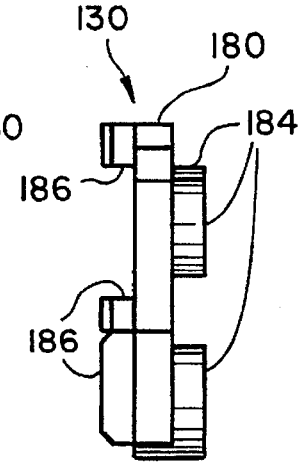
FIG. 28 is a right side elevational view of the funnel cap illustrated in FIGS. 26 and 27 for the electrical cord connector illustrated in FIGS. 18–25.
Figure 29:
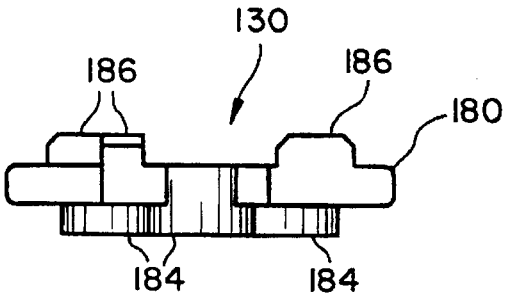
FIG. 29 is a bottom plan view of the funnel cap illustrated in FIGS. 26–28 for the electrical cord connector illustrated in FIGS. 18–25.
Figure 30:
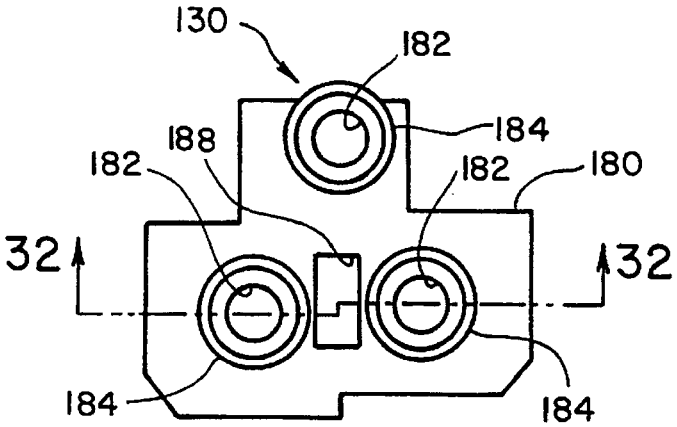
FIG. 30 is a second end elevational view of the funnel cap illustrated in FIGS. 26–29 for the electrical cord connector illustrated in FIGS. 18–25.
Figure 31:
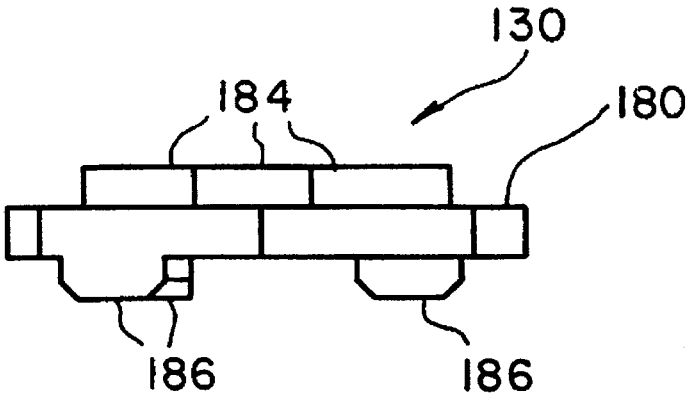
FIG. 31 is a top plan view of the funnel cap illustrated in FIGS. 28–30 for the electrical cord connector illustrated in FIGS. 18–25.
Figure 32:
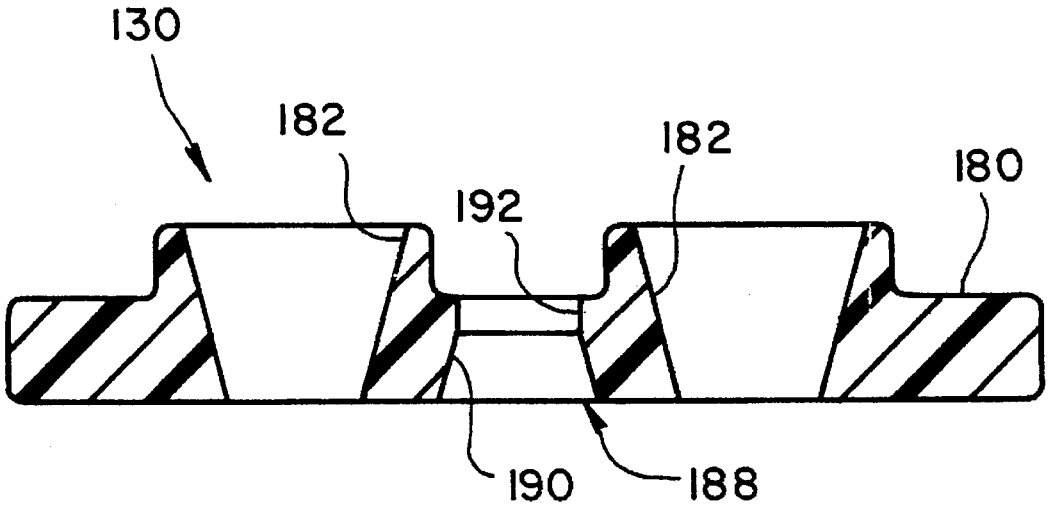
FIG. 32 is an enlarged, cross-sectional view of the funnel cap illustrated in FIGS. 26–31 taken along section line 32—32 of FIG. 31.

Next, funnel cap 130 is coupled to contact retainer body 128 via a tight-fit, e.g., a snap-fit. In particular, as seen in FIG. 23, fastening element 166 passes through fastening slot 188 of cover plate 180 such that protrusions 172 engage the outer surface of cover plate 180 to overridably retain funnel cap 130 to contact retainer body 128. In this position, cover plate 180 covers the open end of terminal cavities 160 with wire openings 182 of cover plate 180 in communication with terminal cavities 160, and tabs 186 being positioned to close off portions of wire openings 162. Thus, funnel cap 130 can be secured to contact retainer body 128 without any screws and without the fear that funnel cap 130 will be dislodged during wiring or assembly of electrical cord connector 110.

Now, conductors 114 are connected to terminals 116. In particular, the free ends of electrical conductors 114 are inserted through wire openings 182 and into their respective terminal cavities 160 such that the stripped ends of the electrical conductors 114 engage terminals 116. Then, screws 118 are tightened down so that the stripped ends of electrical conductors 114 are electrically and fixedly coupled to terminals 116 in a conventional manner.

After electrical conductors 114 are coupled to terminals 116, one of the housing halves 122 or 124 is pivoted so as to form a 90° angle with front cover face 126. In this position, the end of electrical cord 112 is resting on ribs 146 of the pivoted cover half. The installer then pivots the other cover half 122 or 124 so that its ribs 146 engage electrical cord 112. In this position, retaining members 148 abut against cover plate 180 such that cover plate 180 is sandwiched in between retaining members 148 and the free end of contact retainer body 128 to prevent any movement of funnel cap 130. Accordingly, now funnel cap 130 is securely positioned within housing 120 without screws such that terminals 116 cannot be removed without pivoting the cover halves back to their opened or preassembled positions. Finally, screws 136 are threaded to secure cover halves 122 and 124 together.

While only two embodiments have been chosen to illustrate the present invention, it will be understood by those skilled in the art that various changes and modifications can be made herein without departing from the scope of the invention as defined in the appended claims.

What is claimed is:

1. An electrical wiring device adapted to be coupled to an end of an electrical cord with a plurality of electrical conductors, comprising:

a housing including first and second cover halves coupled together to form an electrical cord receiving cavity therebetween, each of said cover halves having a retaining member coupled thereto;

a contact retainer body with a plurality of terminals coupled thereto, said contact retainer body being coupled to said housing and having a plurality of access openings for receiving terminal screws; and a funnel cap with wire openings being retained to said contact retainer body by said retaining members for retaining said terminals in said contact retainer body and for funneling said electrical conductors to said terminals, said contact retainer body and said retaining members being positioned relative to each other to non-movably hold said funnel cap within said housing, said funnel cap and said contact retainer body including a head and socket arrangement for releasably coupling said funnel cap to said contact retainer body, said funnel cap having at least two tabs for engaging said contact retainer body within said plurality of access openings.

2. An electrical wiring device according to claim 1, wherein said funnel cap has three of said wire openings.

3. An electrical wiring device according to claim 2, wherein said head and socket arrangement includes a head member with a pair of protrusions and a socket with a pair of recesses for creating a snap-fit between said funnel cap and said contact retainer body.

4. An electrical wiring device according to claim 3, wherein said head member includes a slot forming a pair of resilient legs.

5. An electrical wiring device adapted to be coupled to an end of an electrical cord with a plurality of electrical conductors, comprising:

a housing formed as a one-piece, unitary member from a plastic material, said housing including a front cover face with at least two contact openings extending therethrough, a contact retainer body integrally formed with said front cover face and extending substantially perpendicularly from said front cover face to a rear end, said contact retainer body having at least two longitudinally extending terminal cavities and at least two screw access openings positioned adjacent to said rear end of said contact retainer body, and first and second cover halves pivotally coupled to said front cover face by a pair of integral hinges to form an electrical cord receiving cavity therebetween, each of said cover halves having a substantially U-shaped transverse cross section with a transverse retaining member integrally formed therewith said retaining members being positioned substantially opposite from each other;

a pair of fasteners releasably coupling said first and second cover halves together;

an electrical contact blade positioned in each of said cavities of said contact retainer body, each of said contact blades having a terminal screw positioned in one of said screw access openings for coupling one of the electrical conductors thereto; and a cap having an inner surface engaging said rear end of said contact retainer body, an outer surface engaging said retaining members of said cover halves and at least two axially extending wire openings extending therethrough, said inner surface of said cap abutting said electrical contact blades for preventing rearward longitudinal movement within said cavities of said contact retainer body, said retaining members being positioned relative to said contact retainer body to abut against said outer surface of said cap to non-movably hold said cap against said rear end of said contact retainer body and to non-movably hold said electrical contact blades within said contact retainer body, said tap further including at least two ribs extending outwardly therefrom and which at least partially surrounds said at least two wiring openings, respectively, cash of said retaining members having a portion with a predetermined thickness where said portion abuts against said cap, and each of said ribs extends outwardly from said cap a distance substantially equal to said thickness of said portion of said retaining members.

6. An electrical wiring device according to claim 5, wherein at least one of said retaining members has a recess formed therein.

7. An electrical wiring device according to claim 5, wherein at least one of said ribs completely surrounds one of said wire openings.

8. An electrical wiring device according to claim 5, wherein said screw access openings are located at said free end of said contact retainer body such that said cap closes off said screw access openings.

9. An electrical wiring device according to claim 5, wherein said electrical contact blades extend through said contact openings of said front cover face to form male contacts.

10. An electrical wiring device according to claim 5, wherein said electrical contact blades are female contacts which are positioned completely within said housing.

11. An electrical wiring device according to claim 5, wherein said U-shaped cross section of each of said first and second cover halves has a back portion and a pair of side portions extending substantially perpendicular to said back portion, and said retaining members are coupled to said back portion and said side portions of its respective said cover half.

12. An electrical wiring device adapted to be coupled to an end of an electrical cord with a plurality of electrical conductors, comprising:

a housing formed as a one-piece, unitary member from a plastic material, said housing including a front cover face with at least two contact openings extending therethrough, a contact retainer body integrally formed with said front cover face and extending substantially perpendicularly from said front cover face to a rear end, said contact retainer body having at least two longitudinally extending terminal cavities and at least two screw access openings positioned adjacent to said rear end of said contact retainer body, and first and second cover halves pivotally coupled to said front cover face by a pair of integral hinges to form an electrical cord receiving cavity therebetween, each of said cover halves having a substantially U-shaped transverse cross section with a transverse retaining member integrally formed therewith said retaining members being positioned substantially opposite from each other;

a pair of fasteners releasably coupling said first and second cover halves together;

an electrical contact blade positioned in each of said cavities of said contact retainer body, each of said contact blades having a terminal screw positioned in one of said screw access openings for coupling one of the electrical conductors thereto; and a cap having an inner surface engaging said rear end of said contact retainer body, an outer surface engaging said retaining members of said cover halves and at least two axially extending wire openings extending therethrough, said inner surface of said cap abutting said electrical contact blades for preventing rearward longitudinal movement within said cavities of said contact retainer body, said retaining members being positioned relative to said contact retainer body to abut against said outer surface of said cap to non-movably hold said cap against said rear end of said contact retainer body and to non-movably hold said electrical contact blades within said contact retainer body, a centrally located fastener being coupled between said cap and said contact retainer body.

13. An electrical wiring device according to claim 12, wherein said fastener is a head and socket arrangement which releasably couples said cap to said contact retainer body via a snap-fit connection.

14. An electrical wiring device adapted to be coupled to an end of an electrical cord with a plurality of electrical conductors, comprising:

a housing formed as a one-piece, unitary member from a plastic material, said housing including a front cover face with at least two contact openings extending therethrough and at least two locking recesses, a contact retainer body integrally formed with said front cover face and extending substantially perpendicularly from said front cover face to a rear end, said contact retainer body having at least two longitudinally extending terminal cavities and at least two screw access openings positioned adjacent to said rear end of said contact retainer body, and first and second coves halves having a substantially U-shaped transverse cross section with each of said first and second cover halves having a back portion, a pair of opposed side portions extending substantially perpendicular to said back portion, a retaining member extending outwardly from said back portion, and an end portion with a cord opening extending substantially perpendicular to said back portion and said side portions, said first and second cover halves having a first end pivotally coupled to said front coves face by a pair of integral hinges to form an electrical cord receiving cavity therebetween, each of said side portions of each of said first and second coves halves having a looking tab for engaging one of said locking recesses; and a pair of fasteners releasably coupling said first and second cover halves together;

an electrical contact blade positioned in each of said cavities of said contact retainer body, each of said contact blades having a terminal screw positioned in one of said screw access openings for coupling one of the electrical conductors thereto; and a cap having an inner surface engaging said rear end of said contact retainer body, an outer surface engaging said retaining members of said cover halves and at least two axially extending wire openings extending therethrough, said inner surface of said cap abutting said electrical contact blades for preventing rearward longitudinal movement within said cavities of said contact retainer body, said retaining members being positioned relative to said contact retainer body to abut against said outer surface of said cap to non-movably hold said cap against said rear end of said contact retainer body and to non-movably hold said electrical contact blades within said contact retainer body, said cap further including at least two ribs extending outwardly therefrom and at least partially surrounding said at least two wire openings, respectively.

15. An electrical wiring device according to claim 14, wherein said screw access openings are located at said free end of said contact retainer body such that said cap closes off said screw access openings.

16. An electrical wiring device according to claim 14, wherein said retaining members are coupled to said side portions of its respective said cover half.

17. An electrical wiring device according to claim 14, wherein said contact retainer body has three said longitudinal cavities with said contact blades positioned therein, and said cap has three of said wire openings extending therethrough which are aligned with said longitudinal cavities, respectively.

18. An electrical wiring device according to claim 14, wherein at least one of said retaining members has recess formed therein.

19. An electrical wiring device according to claim 18, wherein each of said retaining members has a predetermined thickness adjacent said cap, and each of said ribs extends outwardly from said cap a distance substantially equal to said thickness of said retaining members.

20. An electrical wiring device according to claim 19, wherein at least one of said ribs completely surrounds one of said wire openings.

21. An electrical wiring device according to claim 14, further comprising a centrally located fastener coupled between said cap and said contact retainer body.

22. An electrical wiring device according to claim 21, wherein said fastener is a head and socket arrangement which releasably couples said cap to said contact retainer body via a snap-fit connection.

23. An electrical wiring device according to claim 14, wherein each of said cover halves has a clamping member coupled thereto and located adjacent said rear end of said retainer body to engage the electrical cord.

24. An electrical wiring device according to claim 6, wherein said clamping members are integrally formed with said cover halves, respectively.

25. An electrical wiring device adapted to be coupled to an end of an electrical cord with a plurality of electrical conductors, comprising:

a housing formed as a one-piece, unitary member from a plastic material, said housing including a front cover face with at least two contact openings extending therethrough, a contact retainer body integrally formed with said front cover face and extending substantially perpendicularly from said front cover face to a rear end, said contact retainer body having at least two longitudinally extending terminal cavities and at least two screw access openings positioned adjacent to said rear end of said contact retainer body, and first and second cover halves pivotally coupled to said front cover face by a pair of integral hinges to form an electrical cord receiving cavity therebetween, each of said cover halves having a substantially U-shaped transverse cross section with a back portion, a pair of opposed side portions extending substantially perpendicular to said back portion, an end portion with a cord opening extending substantially perpendicular to said back portion and said side portions and a transverse retaining member coupled thereto, one of said retaining members having a recessed portion formed therein for accommodating one of the electrical conductors extending within said housing and into said contact retainer body;

a pair of fasteners releasably coupling said fast and second cover halves together;

electrical contact blade positioned in each of said cavities of said contact retainer body, each of said contact blades having a terminal screw positioned in one of said access openings for coupling one of the electrical conductors thereto; and a cap having an inner surface engaging said rear end of said contact retainer body, an outer surface engaging each of said retaining members of said cover halves and at least two axially extending wire openings extending therethrough, said retaining member with said recessed portion engaging said outer surface of said cap adjacent one of said wire openings, said inner surface of said cap abutting said electrical contact blades for preventing rearward longitudinal movement within said cavities of said contact retainer body, said retaining members being positioned relative to said contact retainer body to abut against said outer surface of said cap to non-movably hold said cap against said rear end of said contact retainer body and to non-movably hold said electrical contact blades within said contact retainer body.

26. An electrical wiring device according to claim 25, wherein retaining members are coupled to said side portions of its respective said cover half.

27. An electrical wiring device according to claim 25, wherein said cap further includes at least two ribs extending outwardly therefrom and which at least partially surrounds said at least two wire openings, respectively.

28. An electrical wiring device according to claim 27, wherein each of said retaining members has a predetermined thickness adjacent said cap, and each of said ribs extends outwardly from said cap a distance substantially equal to said thickness of said retaining members.

29. An electrical wiring device according to claim 27, wherein at least one of said ribs completely surrounds one of said wire openings.

30. An electrical wiring device according to claim 25, further comprising a centrally located fastener coupled between said cap and said contact retainer body.

31. An electrical wiring device according to claim 30, herein said fastener is a head and socket arrangement which releasably couples said cap to said contact retainer body via a snap-fit connection.

32. An electrical wiring device according to claim 30, wherein said screw access openings are located at said free end of said contact retainer body such that said cap closes off said screw access openings.

* * * * *